United States Patent [19]

Kudlacek

[11] 4,060,066

[45] Nov. 29, 1977

[54] COMPOUND ARCHERY BOW WITH ECCENTRIC CAM ELEMENTS

[76] Inventor: Donald S. Kudlacek, 3412 Oak St., Longview, Wash. 98632

[21] Appl. No.: 639,649

[22] Filed: Dec. 11, 1975

[51] Int. Cl.[2] ..... F41B 5/00

[52] U.S. Cl. ..... 124/23 R; 124/90; 124/88

[58] Field of Search ..... 124/35 A, 24 R, 23 R, 124/90, 86, 88

[56] References Cited

U.S. PATENT DOCUMENTS

| | | | |
|---|---|---|---|
| 3,486,495 | 12/1969 | Allen | 124/24 R |
| 3,841,295 | 10/1974 | Hunter | 124/24 R |
| 3,958,551 | 5/1976 | Ketchum | 124/24 R |

*Primary Examiner*—Richard C. Pinkham
*Assistant Examiner*—William R. Browne
*Attorney, Agent, or Firm*—Oliver D. Olson

[57] ABSTRACT

An archery bow includes a pair of bow limbs projecting from opposite ends of a handle member, each eccentrically mounting pivotal cam members at its outer extremity. Each cam member comprises a larger diameter cylindrical cam element and a smaller diameter cylindrical cam element eccentrically joined together and having a common pivot axis which is eccentric with respect to both cam elements. A bow string for projecting an arrow comprises a working stretch and a pair of separate end segments, one detachably connected to each end of the working stretch. Each end segment extends from the working stretch and is wrapped partially around its associated larger diameter cam element, then passes through a diametric bore in the cam member to the opposite side of the smaller diameter cam element, wrapping further around the smaller diameter cam element, and extending therefrom to a connection with the opposite bow limb.

2 Claims, 8 Drawing Figures

Fig. 1.
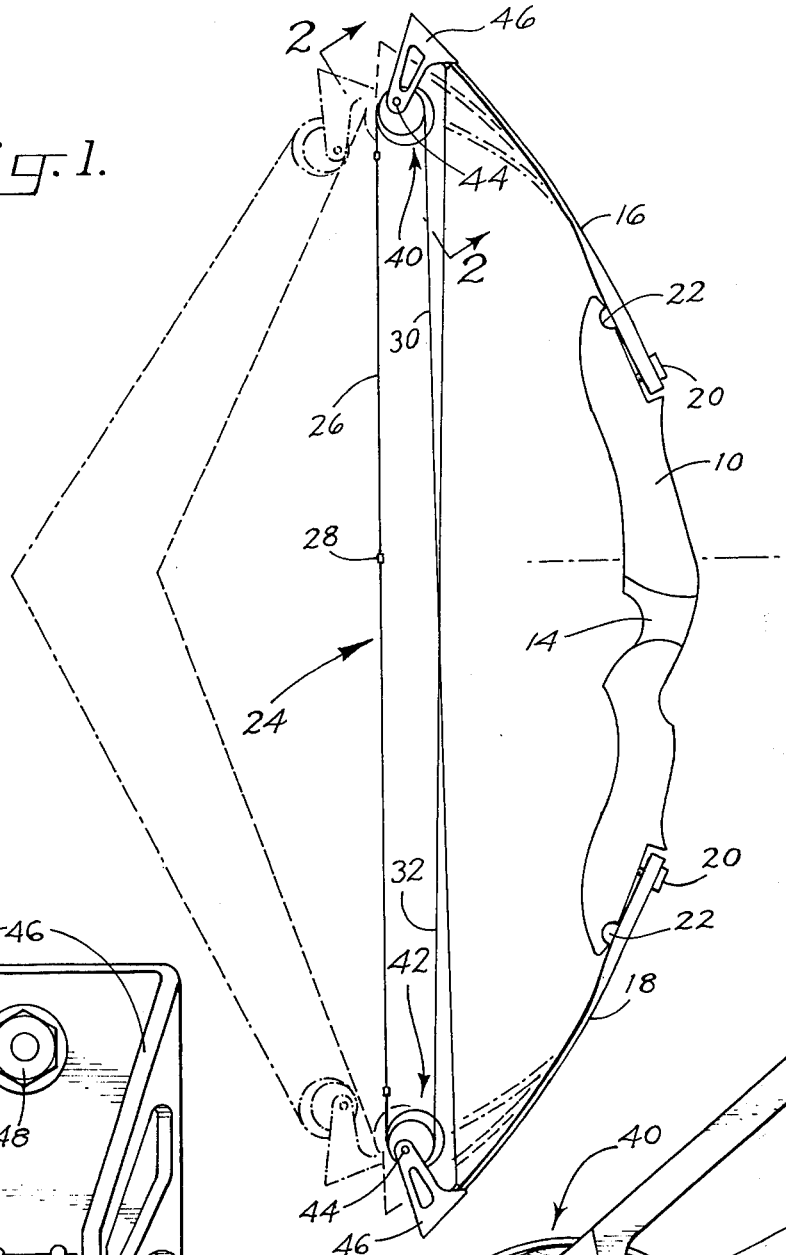
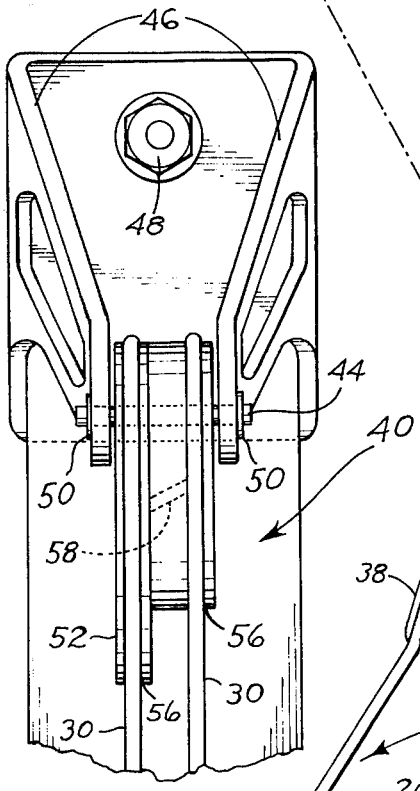
Fig. 2.
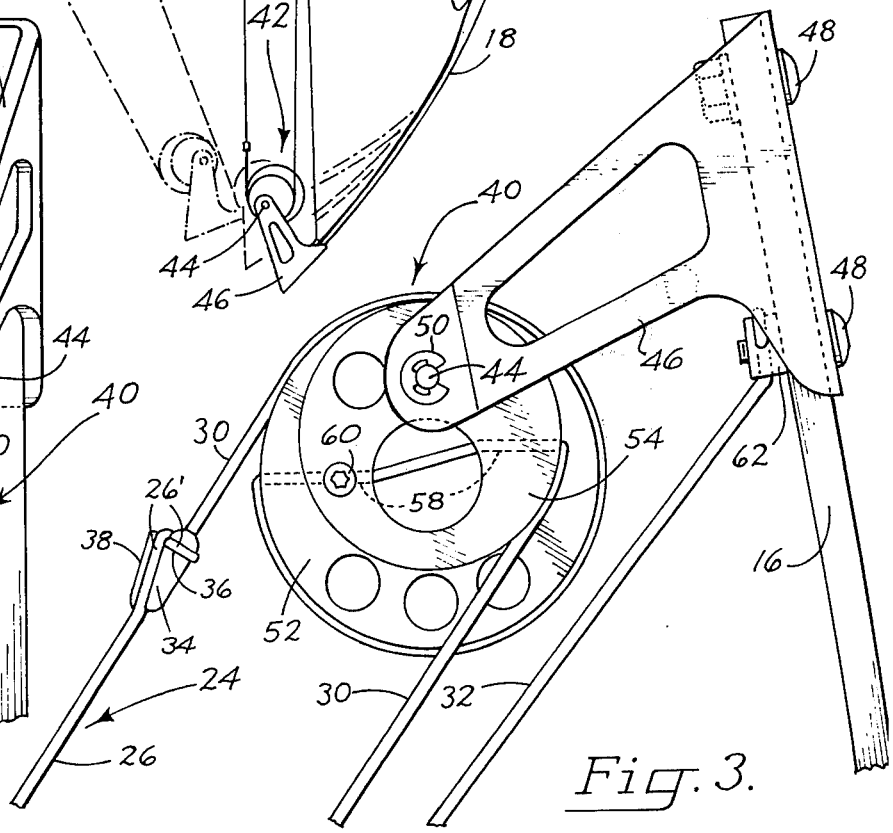
Fig. 3.

COMPOUND ARCHERY BOW WITH ECCENTRIC CAM ELEMENTS

BACKGROUND OF THE INVENTION

This invention relates to archery bows, and more particularly to an archery bow characterized by requiring less pull force at full draw than at an intermediate draw position.

Archery bows of the class described, and commonly referred to as compound bows, have been provided heretofore. Their principal advantage lies in the reduced pull force required at full draw, whereby an archer may utilize a pull force greater than his normal capabilities, while simultaneously affording greater sighting control.

In order further to increase the mechanical advantage and to accommodate adjustment of the drop over point of compound bows, they have been provided with cam members, mounted at each extremity of the limbs, having diametrically different paired cam elements. However, the compound bows provided heretofore with paired cam elements have had their cam elements concentrically joined together. While increasing the force differential between the full draw and intermediate peak draw positions, compared to that of other compound bows, the use of concentric cam elements has been accompanied by certain other disadvantages.

In the prior art compound bows of this class the point of full draw is achieved at a relatively large draw distance. This limits the usefulness of the bows or even prevents their use by persons having short arms.

In addition the time interval between release at full draw and the point when intermediate peak draw is reached, is too short, imparting an excessively large acceleration force on the arrow. This causes loss of arrow stability and may at times even cause its collapse.

Furthermore, the drop over point at full draw is too closely defined on the prior art bows, requiring accurate indexing means to assure that a proper draw is maintained up to the moment of release.

SUMMARY OF THE INVENTION

In its basic concept the archery bow of this invention utilizes cam members eccentrically mounted pivotally at opposite limb ends of the bow, each cam member comprising dual cam elements secured together eccentrically.

It is by virtue of the foregoing basic concept that the principal objective of this invention is achieved; namely, to overcome the aforementioned disadvantages of prior compound archery bows.

Another important objective of this invention is the provision of a compound archery bow having a greater amount of limb flexure than the prior art bows when approximately the same amount of draw force is applied.

A further important objective of this invention is the provision of a compound archery bow having a larger amount of developed energy for a given amount of draw force than prior art bows, to produce greater arrow speed and distance.

The foregoing and other objectives and advantages of this invention will appear from the following detailed description, taken in connection with the accompanying drawings of preferred embodiments.

BRIEF DESCRIPTION OF THE DRAWINGS

FIG. 1 is a view in side elevation of a compound archery bow embodying the features of this invention shown in the relaxed position by the solid lines, at the intermediate peak draw position by the dashed lines, and at the full draw position by the phantom lines.

FIG. 2 is a fragmentary plan view on an enlarged scale taken on the line 2—2 in FIG. 1.

FIGS. 3–5 are fragmentary views in side elevation on an enlarged scale of the cam member at the upper end of the bow of FIG. 1 with the bow respectively in the relaxed position, at the intermediate peak draw position and at the full draw position.

DESCRIPTION OF THE PREFERRED EMBODIMENTS

Figure 4:
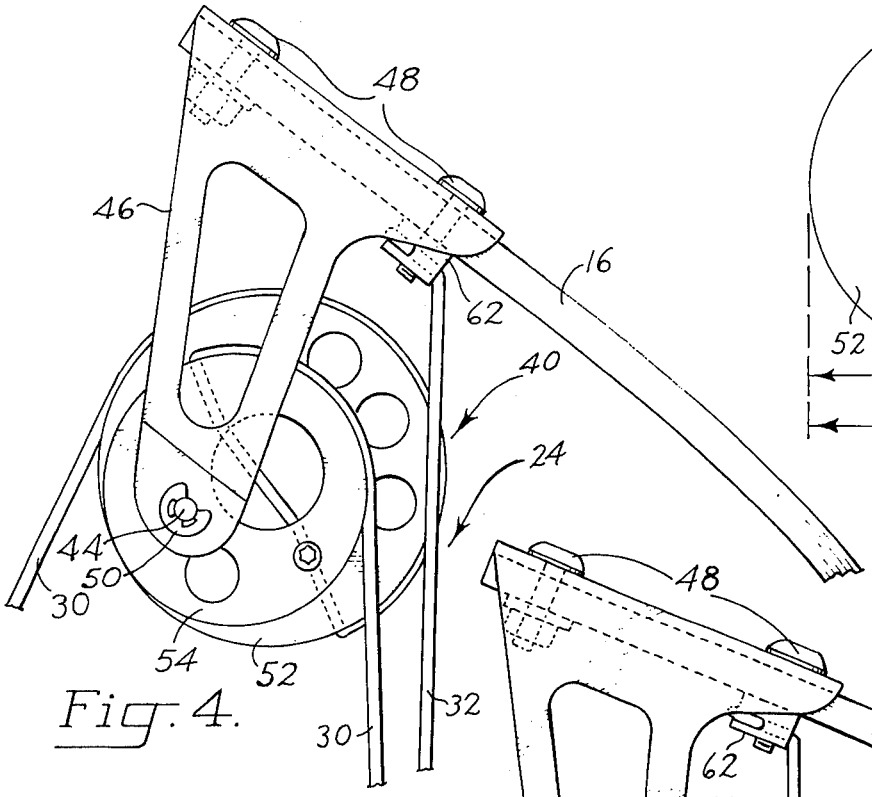

The bow of the present invention includes a central handle member 10 preferably made of light weight metal. As illustrated in FIG. 1, it is provided with a hand grip 14.

A pair of resilient limbs 16 and 18 extends longitudinally outward from each of the opposed ends of the handle member. Although the limbs may be formed integral with the handle, a detachable and angularly adjustable arrangement, such as that illustrated, is preferred. To this end the inner portion of the limbs are connected to the outer ends of the handle by means of screws 20 which extend removably through openings in the limbs. The screws also extend removably through internally threaded holes in the handle.

An inwardly facing semi-spherical bearing surface 22 is located on each of the limbs outwardly of the location of the screw opening. It is configured to engage a mating semi-spherical socket located on each end of the handle. Thus by rotation of the screws 20 to move them longitudinally inwardly or outwardly relative to the handle, the corresponding limb is caused to pivot on bearing surface 22 about the bearing socket. Therefore the angle of each limb relative to the handle may be adjusted independently.

The bow includes a bow string 24 by which an arrow is projected. In the embodiment illustrated the bow string includes an elongate intermediate working stretch 26 provided with the usual nocking point 28 substantially intermediate its ends, and a pair of opposed end segments 30, 32 connected detachably to the opposite ends of the working stretch. The detachable connection of the adjacent ends of the working stretch and end segments preferably is provided by the coupling member, best illustrated in FIG. 3.

The coupling member is of single piece construction and comprises an elongate body 34 having means at one end for securing the body to the end segment. In the embodiment illustrated the end of the end segment is secured in a longitudinal hole in the body of the coupling member, such as by crimping or by the use of an adhesive. Preferably the coupling member is preinstalled on each end segment.

A circumferential groove 36 is located in the body 34 near the end engaging the end segment. The groove is configured to engage, such as by wrapping, the medial portion of a closed flexible loop 26' formed in the adjacent end of the working stretch 26. A pair of laterally extending projections 38 extends in opposite directions from the side of the body from the groove 36 to the end of the body facing the working stretch 26. The projections are spaced apart from the body a distance to allow engagement of the remaining portion of the flexible loop 26' therebetween. Before said remaining portion of the loop is placed under the projection, the loop is twisted by 180° rotation to secure its medial portion about the groove 36 in the body 34.

The coupling member illustrated affords ready attachment and detachment of the working stretch from the end segments and imposes minimum stresses on the adjacent ends. In addition, by sizing the flexible loop in a manner so that it fits closely about the body, as illustrated in FIG. 3, there is little chance of fraying the bow string end loops 26' under repeated drawing of the bow.

The opposite end segments 30, 32 of the bow string are trained about a pair of cam members 40 and 42 respectively, mounted at the outer ends of the limbs 16, 18, respectively, by means of eccentrically located pivot pins 44. As best shown in FIG. 2, each cam member is received freely between laterally spaced, rearwardly projecting flanges 46 of a bracket mounted at the outer end of each limb by means of mounting bolts 48. Each pivot pin 44 is mounted at its opposite ends in apertures located in the flanges and is retained therein by means such as the snap clips 50.

Each cam member comprises a pair of cam elements eccentrically mounted rigidly together, with one cam element 52 being diametrically smaller than the other cam element 54.

Each of the cam elements is in the form of a cylindrical pulley provided with a single peripheral guide groove 56 which retains therein the associated end segment 30 or 32. A diametric bore 58 extends through the cam member interconnecting the guide grooves of the two cam elements.

In the preferred embodiment, best shown in FIG. 3 with the bow in a relaxed position, the end segment 30 of the bow string leading from the upper end of working stretch 26 extends to the upper cam member 40 and is trained about the larger diameter cam element 52 clockwise for about 330°, and then is extended through the diametric bore 58, from the nine o'clock position to the three o'clock position, as shown in FIG. 3. The portion of the segment 30 extending through the diametric bore is secured releasably therein by means of a set screw 60 mounted in a threaded bore in the cam member for retractably intercepting the diametric bore. The end segment leading outwardly from the diametric bore is then wrapped clockwise about the smaller diameter cam element 54 for about 30°, and thence extended substantially parallel to the working stretch to be secured to the opposite, or lower limb 18. The inner mounting bolt 48 supports clamping means 62 to engage the end portion of the end segment.

The end segment 32 leading from the lower end of the working stretch 26 is trained similarly through the elements of the lower cam member 42 thence to attachment to the upper limb 16.

Adjustment of the flexure of the limbs and tension of the bow string is accomplished by selectively drawing the end segments of the bow string longitudinally through the clamping means 62 and securing them therein by tightening the bolts 48.

In the operation of the archery bow of this invention, as the working stretch is drawn from the at rest position, shown by the solid lines of FIG. 1, to an intermediate position, shown by the dashed lines of FIG. 1, the eccentrically mounted cam member 40 at the top of the bow is caused to rotate clockwise about the axis of its pivot pin 44 from the position shown in FIG. 3 to that shown in FIG. 4. Likewise, the eccentrically mounted cam member 42 at the bottom of the bow is caused to rotate a similar amount counterclockwise about its pivot pin.

Figure 5:
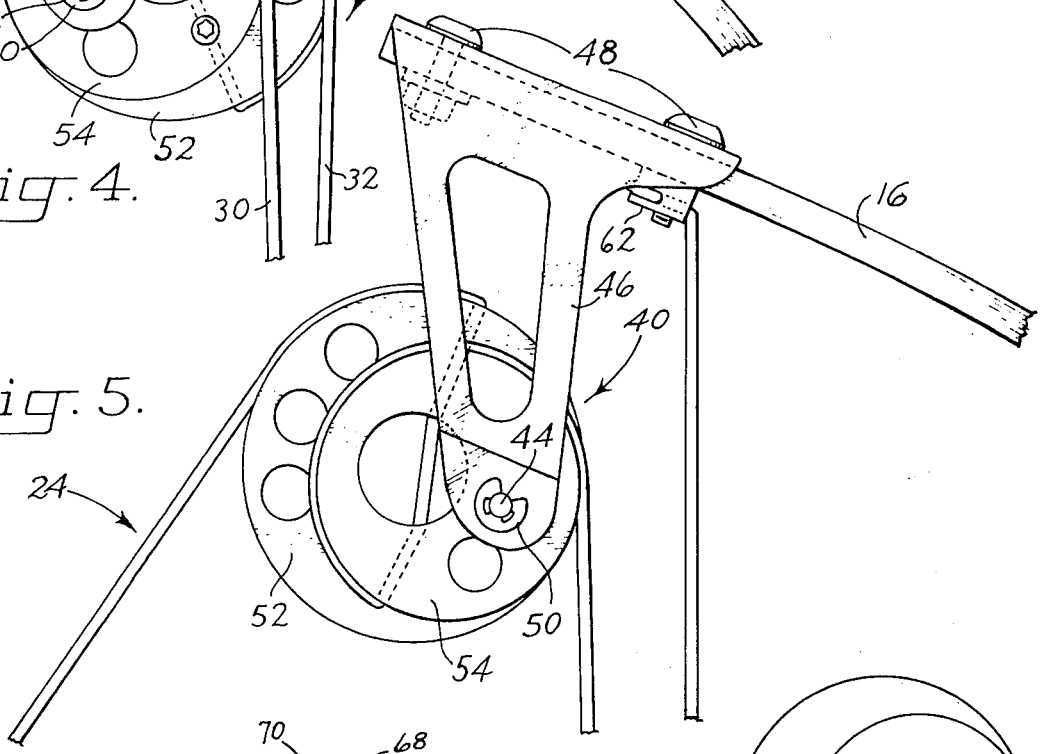

As the working stretch is drawn further from the intermediate position to the full draw position, shown by the phantom lines of FIG. 1, the cam member 40 is caused to rotate further clockwise to the position shown in FIG. 5. Simultaneously the cam member 42 is caused to rotate counterclockwise a similar amount.

Figure 6:
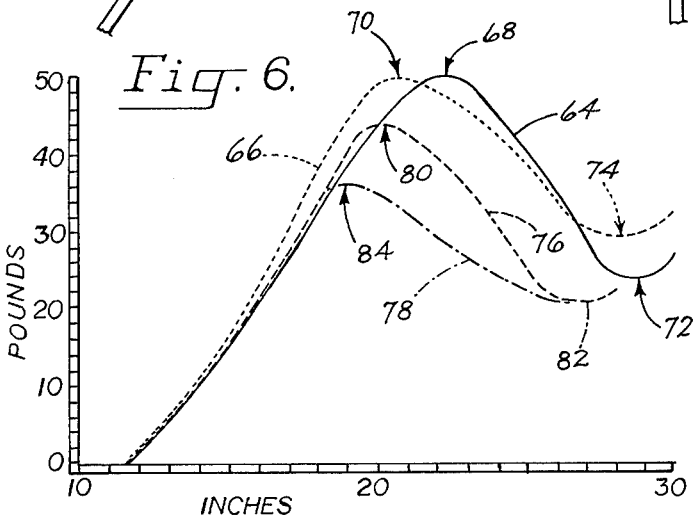
FIG. 6 is a graphical representation of the draw force relative to the draw distance illustrating in broken lines the effects of dimensional variations in cam members of this invention and comparing them with the solid line representation of a concentric cam member of the prior art.

These rotational movements of the eccentrically joined cam elements eccentrically mounted on their respective pivot pins 44 operate to provide a varying pull weight which is characterized by the curves illustrated in the graph of FIG. 6.

The solid line curve 64 of FIG. 6 represents the pull force characteristics of a prior art compound archery bow having two concentrically mounted cylindrical cam elements having the same diameters as the eccentrically mounted cylindrical cam elements of this invention represented by the dotted line curve 66. More particularly the solid line curve represents a compound archery bow having a larger cam element with a $2\frac{1}{4}$ inch diameter and a smaller cam element with a $1\frac{3}{4}$ inch diameter joined concentrically together and having a $\frac{3}{8}$ inch off-center eccentricity of their common pivot pin.

Figure 7:
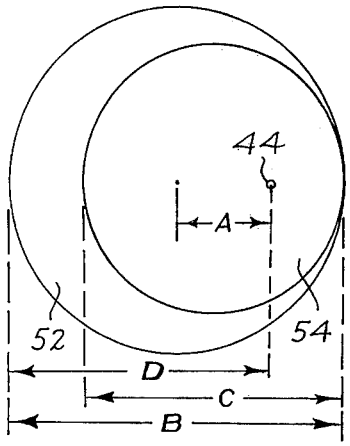
FIG. 7 is a diagram showing the dimensional characteristics of cam members providing the dotted line curve in FIG. 6.

The dotted line curve 66 represents the same compound archery bow having the eccentrically mounted dual cam element arrangement of this invention. As shown in the diagram of FIG. 7, the pivot pin 44 is offset from the center of the larger diameter cam element 52 by a dimension A of $\frac{3}{8}$ inch. The larger cam element 52 has a diameter B of $2\frac{1}{4}$ inches and the smaller cam element 54 has a diameter C of $1\frac{3}{4}$ inch. Thus, the cam member is sized the same as that of the aforementioned prior art concentric cam member to allow direct comparison of the pull force curves generated from each.

As will be noted from the illustration of FIG. 6, the intermediate, peak point 68 and 70 of maximum pull weight for both bows, is at about 50 pounds. This is established by the maximum distance D between the pivot point 44 and the periphery of the larger cam element 52. However, the draw length of the present bow at this position is about $20\frac{1}{2}$ inches in comparison to a draw length of about $22\frac{1}{2}$ inches with the prior art bow. Thus, the point of maximum pull weight is achieved at 2 inches less draw. This feature is especially advantageous for persons having short arms.

It will also be noted from comparing the curves 64 and 66 that the drop over point 72, i.e. the point of minimum pull weight at full draw of the prior art bow, is on a sharper curve than is the drop over point 74 of the curve 66. This flatter curve for point 74 makes it easier for the archer to arrive at and maintain accurate full draw at the drop over point during sighting and shooting. If the bow is released at a point less than full draw, energy is lost. If it is released at a point greater than full draw, the bow string becomes unstable while crossing the drop over point, with significant loss of accuracy. Due to its flatter drop over point, the bow of this invention gives a much greater margin of error in this regard.

Also, since the draw force at full draw 74 is greater for the bow of the present invention than for the prior bow and the draw distance at the intermediate peak position 70 is less, the slope of the draw-force curve between these points is flatter than for curve 64. Therefore, the transition from release at full draw at 74 to maximum force at 70 is smoother for the present bow, thereby contributing to greater arrow stability. With the prior art compound bow which has a steeper slope in its draw-force curve, the high acceleration imparted to the arrow contributes detrimentally to erratic flight and may even cause it to collapse.

Furthermore, it will be noted from the curves that the total energy (energy = the area under the draw-force curve) is greater for the bow of the present invention than for that of the prior art bow. Thus it provides greater arrow speed with increased accuracy and distance. For example, with the aforementioned cam parameters the bow of the instant invention will shoot a 2016 × 29 inch arrow from full draw 75 yards point on (the maximum distance that the bow can be aimed directly at the point of impact). With the same bow having the concentric cam elements of the prior art, at full draw the same arrow will travel only 69 yards point on.

Still further the eccentric cam elements of the present invention give greater limb flexure at full draw than is achieved with the prior art bows. This further contributes to increased arrow speed and correspondingly greater distance and accuracy of arrow flight.

In addition, by altering the eccentricity of the cam members and the respective diameters of the cam elements the draw-force characteristics of the bow can be significantly changed.

Figure 8:
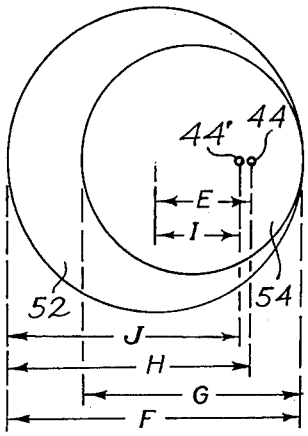
FIG. 8 is a diagram showing the dimensional characteristics of cam members providing the dash line curve and dot-and-dash line curve in FIG. 6.

The dash line curve 76 of FIG. 6 represents a bow having a different cam member configuration from that which provides the curve 70. Referring to FIG. 8, the cam member of the bow in this embodiment has an off-center eccentricity dimension E of ⅜ inch, the same as that in FIG. 7. However, the cam member of this embodiment has a larger cam element 52 with a diameter F of 2 inches and a smaller cam element diameter G of 1½ inches. H represents the maximum distance between the pivot pin 44 and the periphery of the cam element 52.

The dot-and-dash line curve 78 represents yet another embodiment, wherein the cam elements 52 and 54 have the same diameters F and G as for curve 76, but with an offset eccentricity dimension I of 5/16 inch between pivot pin 44' and the center of the larger cam element 52. J represents the maximum distance between the pivot pin 44 and the periphery of cam element 52.

It is to be noted that curve 76 has substantially the same peak point 80 as point 70 of curve 66, since the pivot pin offsets A and E are the same, but the peak weight is less (about 44 pounds) because of the smaller diameter F of the larger cam element. Also, the drop over point 82 and weight are less than point 74 because of the smaller diameter G of the smaller cam element 54.

Further, it is to be noted that curves 76 and 78 have the same drop over point 82 and weight, because of the common cam element 54. However, the peak point 84 of curve 78 is less (18½ inches) than point 80 because of the shorter pivot pin offset I. Also, the peak weight (36 pounds) is less because of the lesser distance J than H. The embodiment providing curve 78 is particularly suitable for use by women and young archers.

It will be apparent to those skilled in the art that various changes may be made in the size, shape, type, number and arrangement of parts described hereinbefore. For example, while the cam elements are shown as being cylindrical, polygonal or oblate cam elements may be used if desired. Further, although the single piece coupling member is advantageous, other types of coupling elements would serve the same purpose. These and other modifications may be made, as desired, without departing from the spirit of this invention.

Having now described my invention and the manner in which it may be used, I claim:

1. A compound archery bow comprising:

a. a handle member, b. a pair of bow limbs projecting from opposite ends of the handle member, c. a pair of cam members each comprising a pair of cam elements of different diameters secured together eccentrically and having a common pivot axis which is eccentric with respect to both cam elements, d. a pivot member on the outer end of each limb pivotally mounting one of the cam members on said pivot axis which is eccentric with respect to both cam elements, and e. a bow string having a medial working stretch segment for projecting an arrow and opposite end segments each extending therefrom and wrapped first over the peripheral surface of the larger diameter cam element of the associated cam member, thence over the peripheral surface of the smaller diameter cam element and being secured to the cam member, and thence extending from the smaller diameter cam element of the associated cam member to attachment with the opposed limb.

2. The compound archery bow of claim 1 wherein the pair of cam elements of each cam member are disposed with their peripheries in a common tangential plane along a common transverse line, the common pivot axis is disposed substantially on a diametrical line through said common transverse line, a bore extends substantially diametrically through the cam member on a line substantially normal to said diametrical line through said common transverse line, the bore communicating at one end with the periphery of the larger diameter cam element and at the opposite end with the peripheral surface of the smaller diameter cam element, the bore receiving therethrough a portion of the bow string intermediate the portions wrapped over the peripheral surfaces of the cam elements, and a set screw retractably intercepts said bore for releasably securing the bow string therein.

* * * * *

REEXAMINATION CERTIFICATE (1356th)

United States Patent [19]

Kudlacek

[11] B1 4,060,066

[45] Certificate Issued Sep. 25, 1990

[54] COMPOUND ARCHERY BOW WITH ECCENTRIC CAM ELEMENTS

[76] Inventor: Donald S. Kudlacek, 3412 Oak St., Longview, Wash. 98632

Reexamination Request:
No. 90/001,881, Nov. 3, 1989

Reexamination Certificate for:

| | |
|---|---|
| Patent No.: | **4,060,066** |
| Issued: | **Nov. 29, 1977** |
| Appl. No.: | **639,649** |
| Filed: | **Dec. 11, 1975** |

[51] Int. Cl.[5] ..... F41B 5/10

[52] U.S. Cl. ..... 124/25.6; 124/88; 124/90; 124/900

[58] Field of Search ..... 124/23 R, 24 R, 90, 124/88, 86, 35 A, DIG. 1, 25.6, 900, 23.1

[56] References Cited

U.S. PATENT DOCUMENTS

| | | | |
|---|---|---|---|
| 3,486,495 | 12/1969 | Allen . | |
| 3,851,638 | 12/1974 | Alexander | 124/24 R |
| 3,854,467 | 12/1974 | Hofmeister | 124/24 R |
| 3,958,551 | 5/1976 | Ketchum . | |
| 3,967,609 | 7/1976 | Frydenlund | 124/24 R |
| 3,987,777 | 10/1976 | Darlington | 124/23 R |
| 4,112,909 | 9/1978 | Caldwell . | |

OTHER PUBLICATIONS

"Archery" May 5, 1975, Cover and Jennings Ad, "Bowhunter" Oct. 10, 1975, Cover and Jennings Ad, Jennings Compound Bow Inc., 1981 Brochure

*Primary Examiner*—Peter M. Cuomo

[57] ABSTRACT

An archery bow includes a pair of bow limbs projecting from opposite ends of a handle member, each eccentrically mounting pivotal cam members at its outer extremity. Each cam member comprises a larger diameter cylindrical cam element and a smaller diameter cylindrical cam element eccentrically joined together and having a common pivot axis which is eccentric with respect to both cam elements. A bow string for projecting an arrow comprises a working stretch and a pair of separate end segments, one detachably connected to each end of the working stretch. Each end segment extends from the working stretch and is wrapped partially around its associated larger diameter cam element, then passes through a diametric bore in the cam member to the opposite side of the smaller diameter cam element, wrapping further around the smaller diameter cam element, and extending therefrom to a connection with the opposite bow limb.

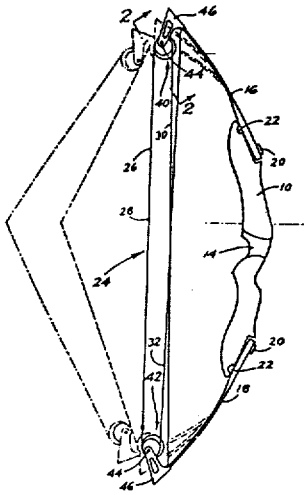

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 is confirmed.

* * * * *